US006343050B1

(12) United States Patent
Kwok

(10) Patent No.: US 6,343,050 B1
(45) Date of Patent: Jan. 29, 2002

(54) ANALOG CLOCK DRIVEN BY RADIO SIGNALS WITH AUTOMATIC RESETTING MEANS

(75) Inventor: Joseph Tak Ming Kwok, Taipo (HK)

(73) Assignee: Moneray International Ltd., Kowloon (HK)

( * ) Notice: Subject to any disclaimer, the term of this patent is extended or adjusted under 35 U.S.C. 154(b) by 0 days.

(21) Appl. No.: 09/544,044

(22) Filed: Apr. 6, 2000

(51) Int. Cl.[7] ..... G04C 11/02; G04C 19/00; G04C 9/00; G04B 25/00; G04B 19/04

(52) U.S. Cl. ..... 368/47; 368/71; 368/80; 368/82; 368/187

(58) Field of Search ..... 368/47, 71, 80, 368/82, 185–187

(56) References Cited

U.S. PATENT DOCUMENTS

| | | | |
|---|---|---|---|
| 4,241,433 | A | 12/1980 | Ueda et al. |
| 4,956,829 | A | 9/1990 | Mitchell |
| 5,442,599 | A | 8/1995 | Burke et al. |

*Primary Examiner*—Vit Miska
(74) *Attorney, Agent, or Firm*—Flehr Hohbach Test Albritton & Herbert LLP

(57) ABSTRACT

An analog clock with a contiguous digital display is driven by radio signals from a WWVB or other time keeping radio station. To avoid using magnetic or optical feedback of the position of the hands of the analog clock if an erroneous time is shown (for example because of replacing the battery), the user of the clock physically resets the digital display to the analog setting (which of course is erroneous). Then an associated microprocessor speeds up or slows down the running of the analog clock until a match is made to the actual radio time.

5 Claims, 3 Drawing Sheets

ANALOG CLOCK DRIVEN BY RADIO SIGNALS WITH AUTOMATIC RESETTING MEANS

The present invention is directed to an analog clock driven by radio signals with automatic resetting means.

BACKGROUND OF THE INVENTION

An analog clock is by definition one which uses a dial face with hour and minute markings and a set of hands to indicate the hour and minute and second. Such timepieces are constructed using a chain of wheels with a proper gear ratio such that as a seconds wheel rotates it progressively turns the minutes wheel and then the hour wheel and thus rotates the hands which are fixed to the shafts of the wheels. The seconds wheel is typically coupled to a stepper motor that is controlled by an associated integrated circuit. Electrical pulses are input to the stepper motor causing the seconds wheel to turn in synchronization with the incoming pulses. In the United States, a radio station WWVB sends a time-coded signal which can be used to control either analog clocks or digital clocks so that the time is always in synchronization with the actual broadcast radio time. Such signal includes the change to and from Daylight Savings Time to automatically reset a clock receiving such signal.

If a clock temporarily malfunctions or its power source is removed, then of course, the clock must be reset. With a digital clock and display this can be done electronically. However, with an analog clock without modification, the driving circuit cannot know what is the erroneous setting of the analog clock display in order to correct it. Prior techniques have used feedback systems incorporating either magnetic or optical means to sense the actual positions of the hands of the analog clock. This is expensive and may not always function adequately.

If the user of the clock is required to reset the time, it is time consuming and in any case, the time accurate to the nearest second is not achievable.

Specifically, one technique of resetting analog hands is using a setting wheel incorporated in the wheel chain so that it is locked into the minutes wheel during setting. A knob fixed to the shaft of the setting wheel for rotation by a user. The minute wheel also rotates the hour wheel at 1/60th of its own speed, and thus the time can be set. This setting method is cumbersome involving too many rotations. Also, since only the minute wheel is set, seconds cannot be set successfully.

Another method is to reset the analog clock electronically by the use of a setting button. Pressing of the button causes the stepper motor to automatically rotate the minute wheel at a relatively fast speed. The user stops at the appropriate time. Again the seconds cannot be adequately set and since only the minutes wheel is actuated, a long time as much as 60 seconds may be required to set the hour hand across a 12-hour span.

All of the foregoing defeats the purpose of an automatically radio controlled clock.

OBJECT AND SUMMARY OF THE INVENTION

It is a general object of the present invention to provide an analog clock driven by radio signals with automatic resetting means.

In accordance with the above object, in a clock display driven by a radio signal providing an actual radio time, such display has an analog clock and display driven by the radio signal and a contiguous digital clock and display. A method of automatically resetting to the actual radio time the analog clock displays without use of feedback, either electrical or mechanical, from the analog display comprising the steps of stopping the analog and digital display and providing user manual controls which allow the user to set the digital display time to the displayed analog time which has been stopped. Thereafter the digital display is compared to the actual radio time and, if less, the analog clock is run at a fast rate until the displayed time is equal to the actual radio time; if more, the analog clock is run at a slow rate until equal. When equal, the analog clock is run responsive to the radio time.

DETAILED DESCRIPTION OF THE PREFERRED EMBODIMENT

Figure 1:
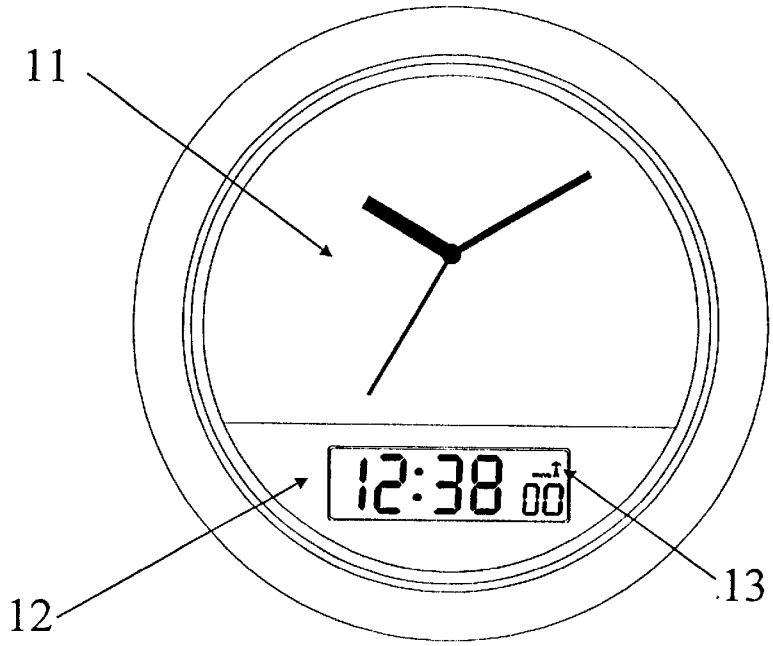
FIG. 1 is a plan view of a clock display showing a combined analog and digital display in one condition.

FIG. 1 is a plan view of a clock display having an analog display portion 11 with hour, minute and second hands indicating a time of 10 hours, 12 minutes and 35 seconds and a digital display 12 indicating a time of 12:38.00. As indicated by the radio signal logo at 13, the digital display is driven by a radio signal from, for example, radio station WWVB and indicates the true or actual radio time. Thus, because of battery failure or malfunction the analog clock display 11 is erroneous.

Figure 2:
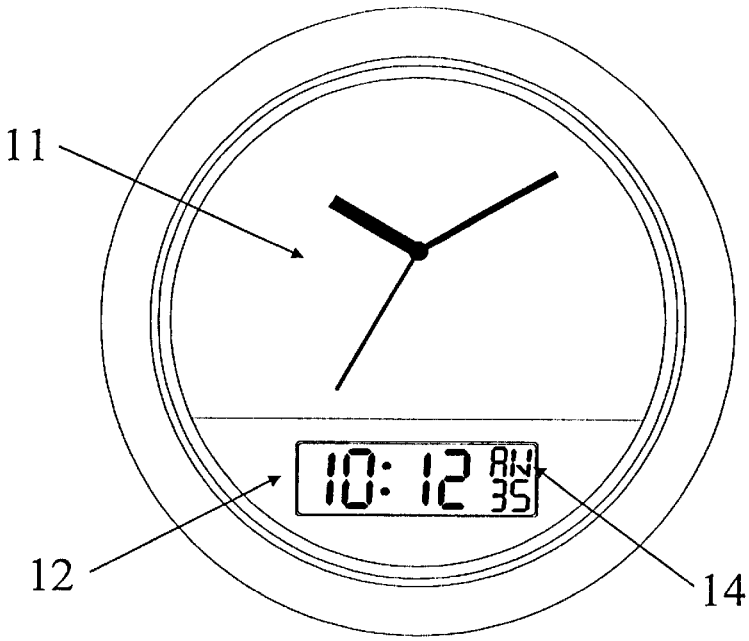
FIG. 2 is a plan view of the clock display in another condition.

FIG. 2 illustrates the same clock display but with digital display 12 showing the actual analog time which is being displayed. Also in the digital display at 14 is a "AN" indicator indicating that analog calibration will be carried out to automatically and electronically reset the analog display to the actual radio time.

Figure 3:
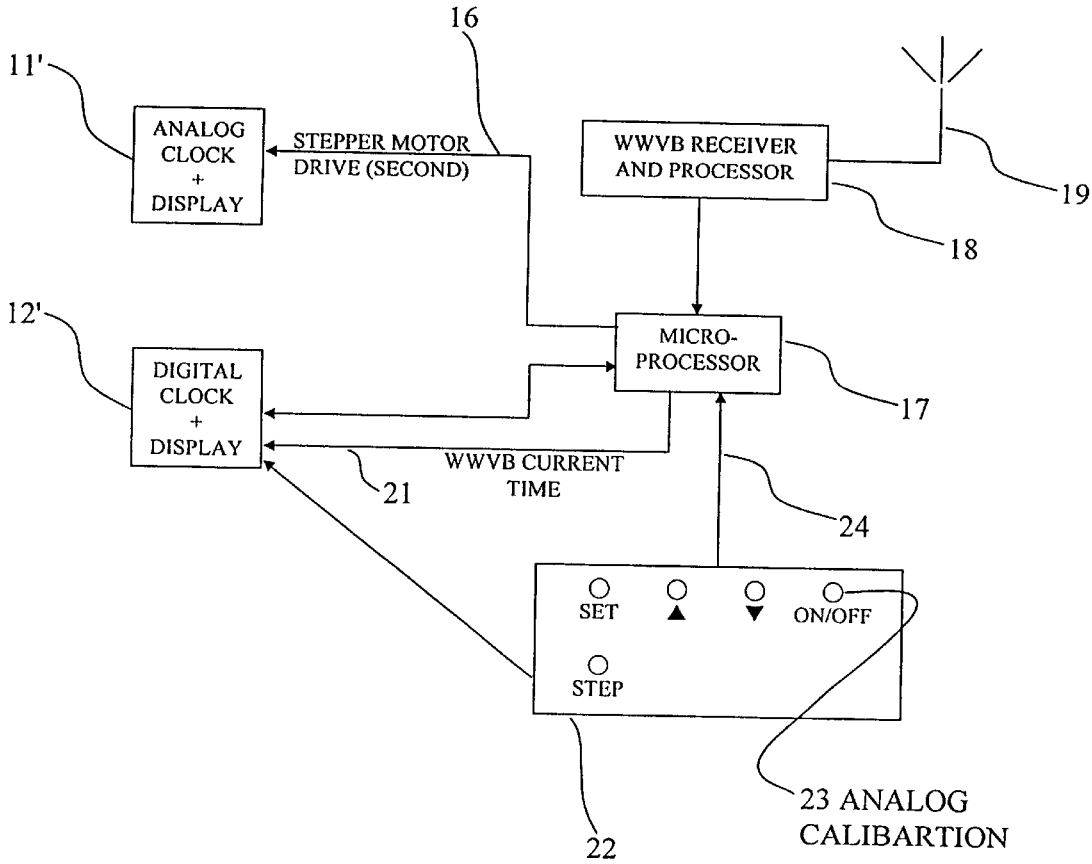
FIG. 3 is block diagram of the electrical circuitry associated with the present invention.

FIG. 3 is the electronic circuit associated with the analog clock and display 11' and digital clock and display 12'. As discussed above, the analog clock 11' is driven on a line 16 by stepper motor pulses, 1 per second, which are provided by microprocessor 17. This microprocessor is connected to a receiver and processor 18 which via the antenna 19 receives radio signals from WWVB. All of the foregoing is well-known. Microprocessor 17 on line 21 also drives the digital clock and display 12' in a manner well known. Associated with the digital clock and display is a user control panel 22 where, as indicated by the labeled buttons, "SET" "▲" and "▼" may be used to set the hours, minutes and seconds, into the digital display 12 by the user. A separate button named "STEP" is used to step the second hand. User control panel 22 also contains an analog calibration switch 23 labeled ON/OFF whose function will be described below. User control unit 22 is, of course, connected via line 24 to microprocessor unit 17.

Figure 4:
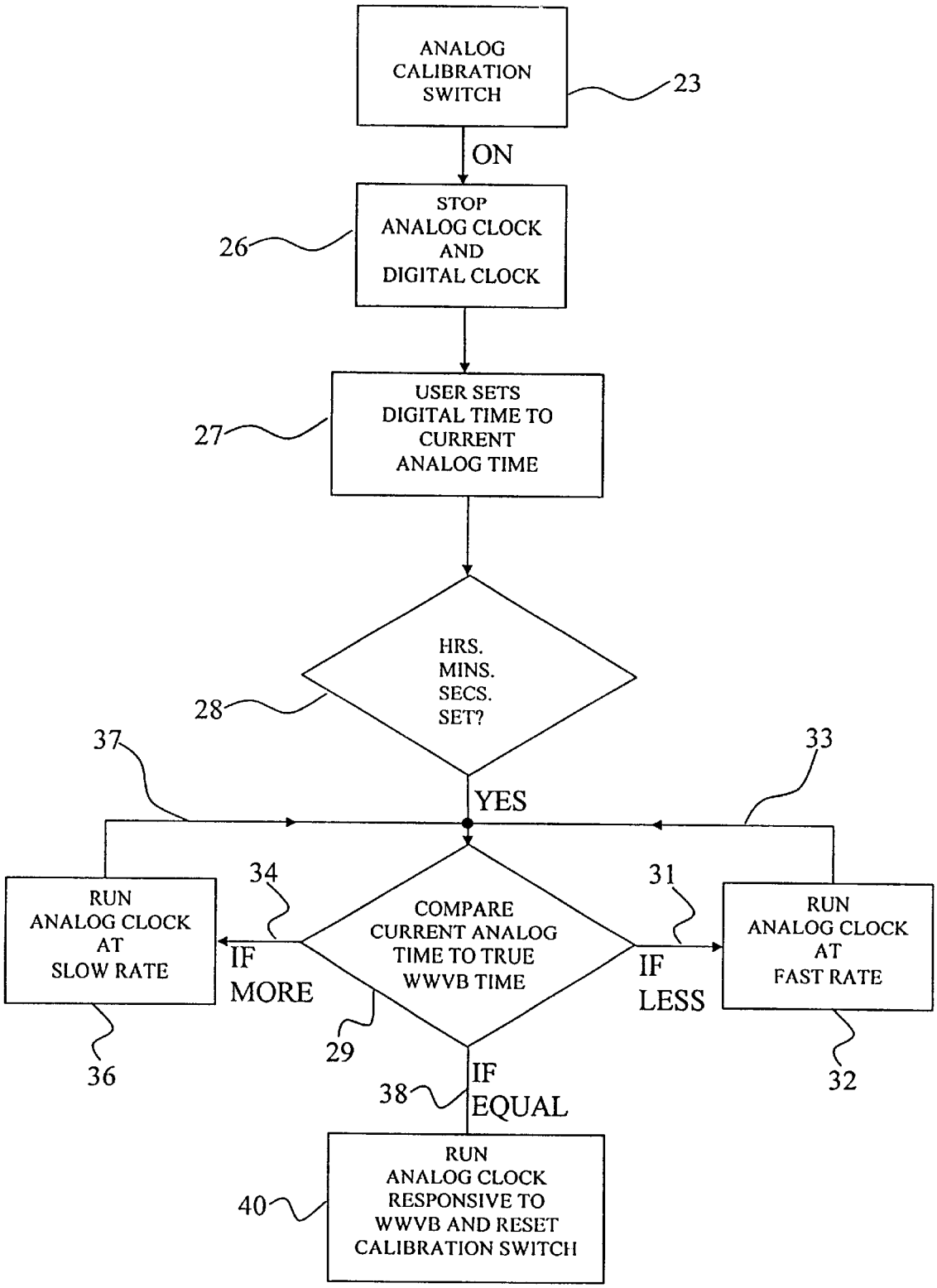
FIG. 4 is a flow chart illustrating the operation of the present invention.

Referring now to FIG. 4, this is a flow chart which shows the functioning of microprocessor 17 in resetting the erroneous analog display 11 illustrated in FIG. 1 to the actual radio time provided by radio signal WWVB as shown by the digital display 12. Initially, the user, seeing this discrepancy, would set the analog calibration switch 23 to ON as illustrated in FIG. 4. Next in step 26, both movement of the analog and digital clock displays, are stopped. Normally, they would both be driven in synchronization with the pulses broadcast by the radio signal. Then in Step 27, the user sets the digital time display 12 as illustrated in FIG. 2 to the currently displayed analog time. The analog calibration switch when it is switched to the ON position sets the indicator 14 as illustrated in FIG. 2 to AN, indicating that the resetting or calibration procedure is now being carried out. When the user has set the proper hours, minutes and seconds in the display 12, in step 28 this is recognized by microprocessor 17 and the next compare step 29 is effected. The current analog time as contained now in the digital display 12 is compared to the true or current radio time as broadcast by WWVB. If this analog time is less, the branch 31 is taken and in step 32 the analog clock is run at a very fast rate through a turn on line 33 being made to step 29. As shown by the branch 34, if the analog time is more, then the analog clock at step 36 is run at a slow rate. When equality occurs (see returns 33 and 37 to step 29), it is indicated by the branch 38. The analog clock is then run in a normal manner responsive to the radio signal as indicated in step 40 and the reset calibration switch 23 reset to OFF position.

Thus, the microprocessor 17 having been inputted the actual position of the analog hands can calculate that the time shown by the analog clock is fast or slow and by how much. Then sending pulses to the stepper motor to catch up for lost time or sending in less pulses per second to slow it down, the correct time indication is achieved. The microprocessor can keep track of in what position the hands are since it has received an accurate initial position.

The present invention, therefore, provides for automatic resetting of an analog clock without a need of optical or magnetic feedback as to the position of the hands of the clock.

What is claimed is:

1. In a clock display driven by a radio signal providing an actual radio time having an analog clock and display driven by the radio signal and a contiguous digital clock and display including a method of automatically resetting to the actual radio time the analog clock display without use of feedback, either electrical or mechanical, from the analog display comprising the following steps:

stopping the analog and digital displays;

providing user manual controls and allowing the user to set the digital display time to the displayed analog time which has been stopped;

thereafter comparing the digital display to the actual radio time and, if less, running the analog clock at a fast rate until the displayed time is equal to the actual radio time, if more, running the analog clock at a slow rate until equal;

and when equal running the analog clock responsive to said actual radio time.

2. A method as in claim 1 where said analog clock and display includes a stepper motor driving a seconds wheel which is responsive to said radio signal.

3. A method as in claim 1 where said manual controls include means for stepping an analog second hand.

4. A method as in claim 2 where manual controls include button means for driving said stepper motor.

5. A clock display driven by a radio signal providing an actual radio time comprising an analog clock and display driven by said radio signal;

a contiguous digital clock and display also driven by said radio signal;

means for automatically resetting the analog display to the actual radio time including manual user control means, including means for allowing the user to set the hour, minute and second of the digital display and including means for stopping both said analog and digital displays and including means for comparing the digital displayed time which has been set by the user control means to the actual radio time;

and including means for running the analog clock at a fast rate if less than the radio time until equal to the radio time and for running the analog clock at a slow rate if more than the radio time until equal and;

means for allowing the analog clock to be responsive to said radio time in a normal manner.

* * * * *